US010323468B2

(12) United States Patent
Patel

(10) Patent No.: US 10,323,468 B2
(45) Date of Patent: Jun. 18, 2019

(54) WELL INTEGRITY MONITORING SYSTEM WITH WIRELESS COUPLER

(71) Applicant: Schlumberger Technology Corporation, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 47 days.

(21) Appl. No.: 15/308,910

(22) PCT Filed: Jun. 4, 2015

(86) PCT No.: PCT/US2015/034112
§ 371 (c)(1),
(2) Date: Nov. 4, 2016

(87) PCT Pub. No.: WO2015/187908
PCT Pub. Date: Dec. 10, 2015

(65) Prior Publication Data

US 2017/0074048 A1 Mar. 16, 2017

Related U.S. Application Data

(60) Provisional application No. 62/008,205, filed on Jun. 5, 2014, provisional application No. 62/014,499, filed on Jun. 19, 2014.

(51) Int. Cl.
*E21B 17/00* (2006.01)
*E21B 47/12* (2012.01)
(Continued)

(52) U.S. Cl.
CPC ..... *E21B 17/003* (2013.01); *E21B 17/028* (2013.01); *E21B 23/01* (2013.01);
(Continued)

(58) Field of Classification Search
CPC ..... E21B 17/003; E21B 17/028; E21B 23/01; E21B 47/06; E21B 47/12; E21B 47/122; E21B 44/00; E21B 47/13
See application file for complete search history.

(56) References Cited

U.S. PATENT DOCUMENTS 5,174,340 A 12/1992 Peterson et al.
6,311,774 B1 11/2001 Brockman et al.
(Continued)

FOREIGN PATENT DOCUMENTS

EP 2569512 A2 3/2013
WO W02012091575 A1 7/2012

OTHER PUBLICATIONS

PCT/US2015/033931 International Search Report and Written Opinion, dated Aug. 25, 2015, 13 pgs.
(Continued)

*Primary Examiner* — Yong-Suk Ro

(57) ABSTRACT

A technique combines a wireless coupler system with casing to communicate signals from and/or to a device external to the casing. The wireless coupler system may comprise an inductive coupler system formed with a female inductive coupler disposed along an exterior of the well casing and a male inductive coupler mounted along tubing disposed within the well casing. The female inductive coupler is operatively coupled with the sensor and the male inductive coupler is operatively coupled with a communication line routed along the tubing. The inductive coupler system is constructed to facilitate alignment of the male inductive coupler with the female inductive coupler as the tubing is moved along an interior of the well casing. Additionally, the inductive coupler system may be constructed with a bypass channel to facilitate the flow of fluid and routing of communication lines through the inductive coupler system.

20 Claims, 7 Drawing Sheets

(51) Int. Cl.

| | |
|---|---|
| ***E21B 17/02*** | (2006.01) |
| ***E21B 23/01*** | (2006.01) |
| ***E21B 47/06*** | (2012.01) |

(52) U.S. Cl.

CPC ..... *E21B 47/06* (2013.01); *E21B 47/12* (2013.01); *E21B 47/122* (2013.01)

(56) References Cited

U.S. PATENT DOCUMENTS

| | | | |
|---|---|---|---|
| 7,168,487 | B2 | 1/2007 | Salamitou et al. |
| 7,212,173 | B2 | 5/2007 | Chen et al. |
| 7,795,872 | B2 | 9/2010 | Clark et al. |
| 8,334,786 | B2 | 12/2012 | Bowles et al. |
| 8,683,859 | B2 | 4/2014 | Godager |
| 8,689,621 | B2 | 4/2014 | Godager |
| 9,000,873 | B2 | 4/2015 | Deville et al. |
| 2002/0066561 | A1 | 6/2002 | Brockman |
| 2002/0114216 | A1 | 8/2002 | Veneruso et al. |
| 2004/0094303 | A1 | 5/2004 | Brockman et al. |
| 2004/0263414 | A1 | 12/2004 | Chen et al. |
| 2007/0227727 | A1 | 10/2007 | Patel et al. |
| 2009/0045974 | A1 | 2/2009 | Patel |
| 2010/0025045 | A1 | 2/2010 | Lake et al. |
| 2011/0284216 | A1 | 11/2011 | Addis et al. |
| 2013/0048269 | A1 | 2/2013 | Tarayre et al. |
| 2014/0266210 | A1 | 9/2014 | Godager |
| 2016/0268041 | A1 | 9/2016 | Deville et al. |
| 2017/0074048 | A1 | 3/2017 | Patel |

OTHER PUBLICATIONS

GCC First Examination Report for corresponding GCC Application Serial No. 2015/29508, dated Jan. 11, 2018, 4 pages.

GCC Second Examination Report for corresponding GCC Application Serial No. 2015/29508, dated Jul. 20, 2018, 4 pages.

International Search Report and Written Opinion issued in related International Application Serial No. PCT/US2014/064522, dated Feb. 23, 2015, 8 pages.

Mexican Official Action issued in related Application Serial No. Mx/a/2016/005910, dated Jun. 14, 2018, with English Summary, 7 pages.

European Search Report issued in related European Application Serial No. 14860907.6, dated Jun. 13, 2017, 11 pages.

WELL INTEGRITY MONITORING SYSTEM WITH WIRELESS COUPLER

CROSS-REFERENCE TO RELATED APPLICATION

The present document is based on and claims priority to U.S. Provisional Application Ser. No. 62/008,205, filed Jun. 5, 2014 and U.S. Provisional Application Ser. No. 62/014,499, filed Jun. 19, 2014, both of which are incorporated herein by reference in their entirety.

BACKGROUND

A wide variety of well equipment may be installed in a well to facilitate operation and monitoring of the well. For example, the well equipment may comprise completion systems installed in a wellbore to enable production of hydrocarbon fluids, such as oil and gas, or to facilitate injection of fluids into the well. The well equipment often includes electrical devices which are powered. In some applications, the electrical devices also provide data which is transmitted to a control system located at a surface of the earth or at another suitable location. In some applications, the power and/or data signals may be transmitted through inductive couplers. However, the inductive couplers can detrimentally provide an obstruction with respect to passage of control lines and/or fluids.

SUMMARY

In general, a system and methodology are provided for utilizing a wireless coupler system with tubing, e.g. well casing, to communicate signals from and/or to a device, e.g. sensor, external to the tubing. According to an embodiment, the wireless coupler system comprises an inductive coupler system formed with a female inductive coupler disposed along a casing and a male inductive coupler mounted along tubing disposed within the casing. The female inductive coupler is operatively coupled with the device/sensor and the male inductive coupler is operatively coupled with a communication line routed along the tubing. The wireless, e.g. inductive, coupler system is constructed to facilitate alignment of the male coupler with the female coupler as the tubing is moved along an interior of the casing. Additionally, the wireless coupler system may be constructed with bypass channels to facilitate flow of fluid and routing of communication lines through the wireless coupler system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
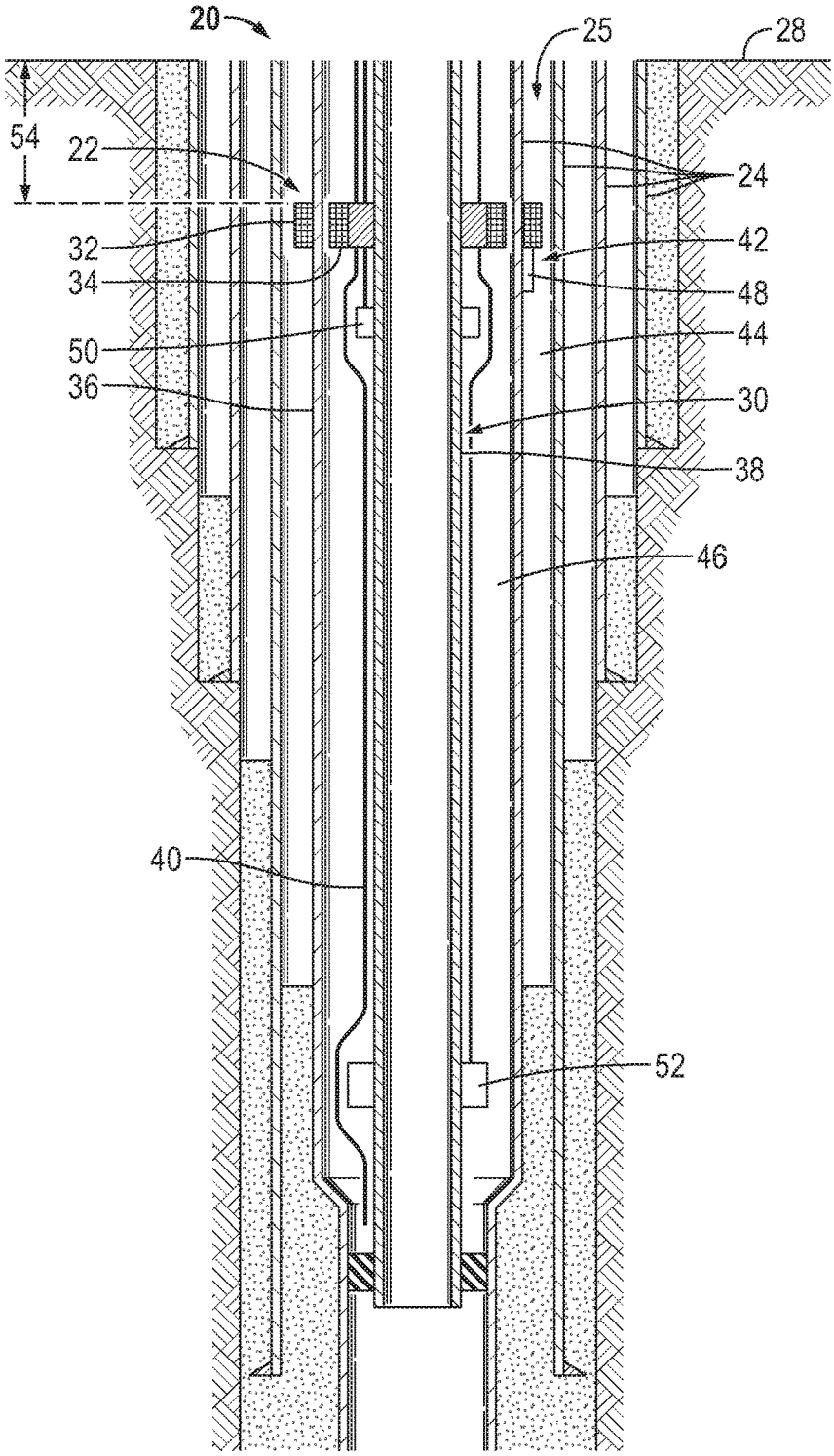
FIG. 1 is a schematic illustration of an example of a well system utilizing a wireless coupler system in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for utilizing a wireless coupler system to communicate signals, e.g. data and/or power signals, across a tubing, e.g. casing. The wireless coupler system facilitates alignment of a male coupler with a female coupler while on interior and exterior sides of the casing, respectively. In an embodiment, the wireless coupler system comprises an inductive coupler system which may be used with well casing deployed along a subsea wellbore extending into a subterranean formation. The inductive coupler system comprises an inner or male inductive coupler and an outer or female inductive coupler each having an inductive coil. In well applications, the inner or male inductive coupler may be mounted on tubing and moved into a surrounding casing until aligned with the female inductive coupler for communication of signals across the casing.

According to an embodiment, the inductive coupler system is constructed with a female inductive coupler disposed along an exterior of a well casing and a male inductive coupler is mounted along tubing disposed within the casing. For example, the tubing may be a well string which is moved into a surrounding well casing until the male inductive coupler is properly aligned with the female inductive coupler. The female inductive coupler may be operatively coupled with a device, e.g. sensor, disposed externally of the well casing. By way of example, the sensor may be a pressure sensor position to monitor pressure in an annulus surrounding the casing. However, the sensor may comprise various other and/or additional sensors such as temperature sensors, flow sensors, resistivity sensors, and/or other suitable sensors.

In this example, the male inductive coupler is operatively coupled with a communication line routed along the tubing. For example, the male inductive coupler may be connected with an electrical or optical fiber communication line which is routed uphole along the tubing to a control system located at the surface or at another suitable location. The inductive coupler system is constructed to facilitate alignment of the male inductive coupler with the female inductive coupler to help optimize transmission of signals between the exterior and interior of the casing once the tubing has been moved to a desired position within the casing. However, the alignment techniques described herein may be employed with other wireless coupling systems. Additionally, the wireless, e.g. inductive, coupler system may be constructed with bypass channels to facilitate flow of fluid and routing of communication lines through the wireless coupler system. The bypass channels enable substantial fluid flow when, for example, deploying the tubing string downhole or when killing the well. The bypass channels also provides space for a variety of communication lines, e.g. electrical lines, fiber-optic lines, hydraulic lines, chemical injection lines, and/or other lines, routed along the tubing and through the wireless coupler system.

In many applications, data may be sent from or to the sensor (or other electrical device) across the casing via the inductive coupler system. Depending on the application, power signals also may be transferred across the casing via the inductive coupler system. However, the data signals and/or power signals also may be transferred across the casing via other types of wireless coupler systems, e.g. toroidal coupler systems. In an inductive coupler system embodiment, a male inductive coupler is positioned at a location which allows it to cooperate with the outer, female inductive coupler for transmitting signals across the casing. Embodiments described herein use induction principles to enable power and/or information data to be conveyed between the male and female inductive couplers. The male inductive coupler and the female inductive coupler each may comprise, for example, at least one coil, a magnetic core, and a metal sleeve enclosing the at least one coil and magnetic core. The coil and magnetic core of the male inductive coupler are moved via the tubing into substantially radial alignment with the coil and magnetic core of the female inductive coupler to facilitate inductive transfer of power and/or data signals.

A magnetic field is created by running electrical current through the coil or coils of one of the inductive couplers. The electrical current induces a current flow in the opposed coil or coils of the other inductive coupler. This allows power and/or data signals to be transferred across the casing, i.e. across the casing wall. In embodiments described herein, the configuration of the inductive coupler system enables desirable alignment of the male inductive coupler with the female inductive coupler while also enabling passage of substantial fluid flows and communication lines through the inductive coupler system. In some applications, the male inductive coupler may be positioned along a tubing while being decoupled from the tubing. For example, the male inductive coupler may be slid over the tubing so that the tubing integrity is not compromised by threadably or otherwise engaging the male inductive coupler with the tubing. By decoupling the male inductive coupler from the tubing, the male inductive coupler is not subjected to various tubing loads, e.g. tension, compression, torsion, differential pressure across tubing, and/or other loads. Consequently, the male inductive coupler may be constructed more economically from lower grade material than that used for the tubing material. In some applications, the female inductive coupler may be similarly decoupled from the casing.

Referring generally to FIG. 1, an example of a well system 20 having a wireless coupler system 22 is illustrated. In embodiments described below, the wireless coupler system 22 is in the form of an inductive coupler system, but other wireless coupler systems, e.g. toroidal systems, also may be employed. The well system 20 comprises at least one and often a series of casings 24 which may be disposed along a wellbore 25 drilled into a subterranean formation 26. In this example, the well system 20 is a subsea well system and the wellbore 24 is drilled into formation 26 beneath a seabed 28. A tubing 30, e.g. a well tubing string, is deployed downhole along an interior of the internal casing 24. Additionally, the inductive coupler system 22 is positioned to facilitate communication of signals, e.g. data and/or power signals, across the corresponding casing 24. In some well applications, the well casing(s) 24 may be formed of non-magnetic, low conductivity metal.

The wireless coupler system 22 comprises a female coupler 32, e.g. a female inductive coupler 32, which may be mounted along an exterior of the corresponding casing 24. Additionally, the wireless coupler system 22 comprises a male coupler 34, e.g. a male inductive coupler 34, positioned to the interior of the same casing 24. By way of example, the female inductive coupler 32 may be mounted to an exterior 36, e.g. outside surface, of casing 24 and the male inductive coupler 34 may be mounted along an exterior 38 of tubing string 30. In an embodiment, the female inductive coupler 32 may be slid over the casing 24 and/or the male inductive coupler 34 may be slid over the tubing 30. By sliding the female inductive coupler 32 over the casing 24 and/or the male inductive coupler 34 over the tubing 30, the couplers may effectively be decoupled from the corresponding casing/tubing. As described in greater detail below, the inductive coupler system 22 may comprise a passage or a plurality of passages to accommodate fluid flow therethrough as well as the routing of a communication line or lines 40 therethrough. Examples of communication lines 40 include hydraulic lines, electrical lines, fiber-optic lines, chemical injection lines, and other types of lines routed downhole along tubing 30. In the specific example illustrated, the communication line(s) extends through the male inductor coupler 34.

According to an embodiment, the female inductive coupler is operatively coupled with a sensor or other electrical device 42 located outside of the subject casing 24. For example, the sensor 42 may be positioned in an annulus 44, sometimes referred to as a B-annulus, which is located outside of the subject casing 24 and externally of the A-annulus 46 between tubing string 30 and the subject casing 24. In some applications, the sensor 42 may comprise a pressure sensor 48, e.g. a pressure gauge, to monitor pressure along the B-annulus 44 and the pressure data be used to determine well integrity. However, the sensor 42 may comprise a variety of other and/or additional sensors, including temperature sensors, resistivity sensors, flow sensors, or other suitable sensors for a given well application. The sensor 42 is coupled with female inductive coupler 32 so that signals may be wirelessly transferred across casing 24 to male inductive coupler 34. Depending on the application, data and/or power signals may be transferred across casing 24 to or from the sensor/electrical device 42.

As further illustrated in FIG. 1, a variety of other sensors, e.g. sensors 50 and 52, may be employed in well system 20. In some applications, the lower sensor 52 may be a pressure sensor positioned in the A-annulus 46 to monitor pressure along the tubing 30. However, a variety of additional and/or other types of sensors may be positioned along the tubing string 30 for monitoring a variety of desired parameters. Depending on the application, the sensors 50, 52 may be coupled with the male inductive coupler 34 or they may be coupled with communication lines routed through the male inductive coupler 34 to a control system, e.g a computer-based control system located at the surface. It should be noted that in some applications, the inductive coupler system 22 may be located a relatively short distance 54, e.g. 10 feet, below the seabed 28. However, other applications may position the inductive coupler system 22 at a variety of depths along the casing 24 and tubing string 30.

Figure 2:
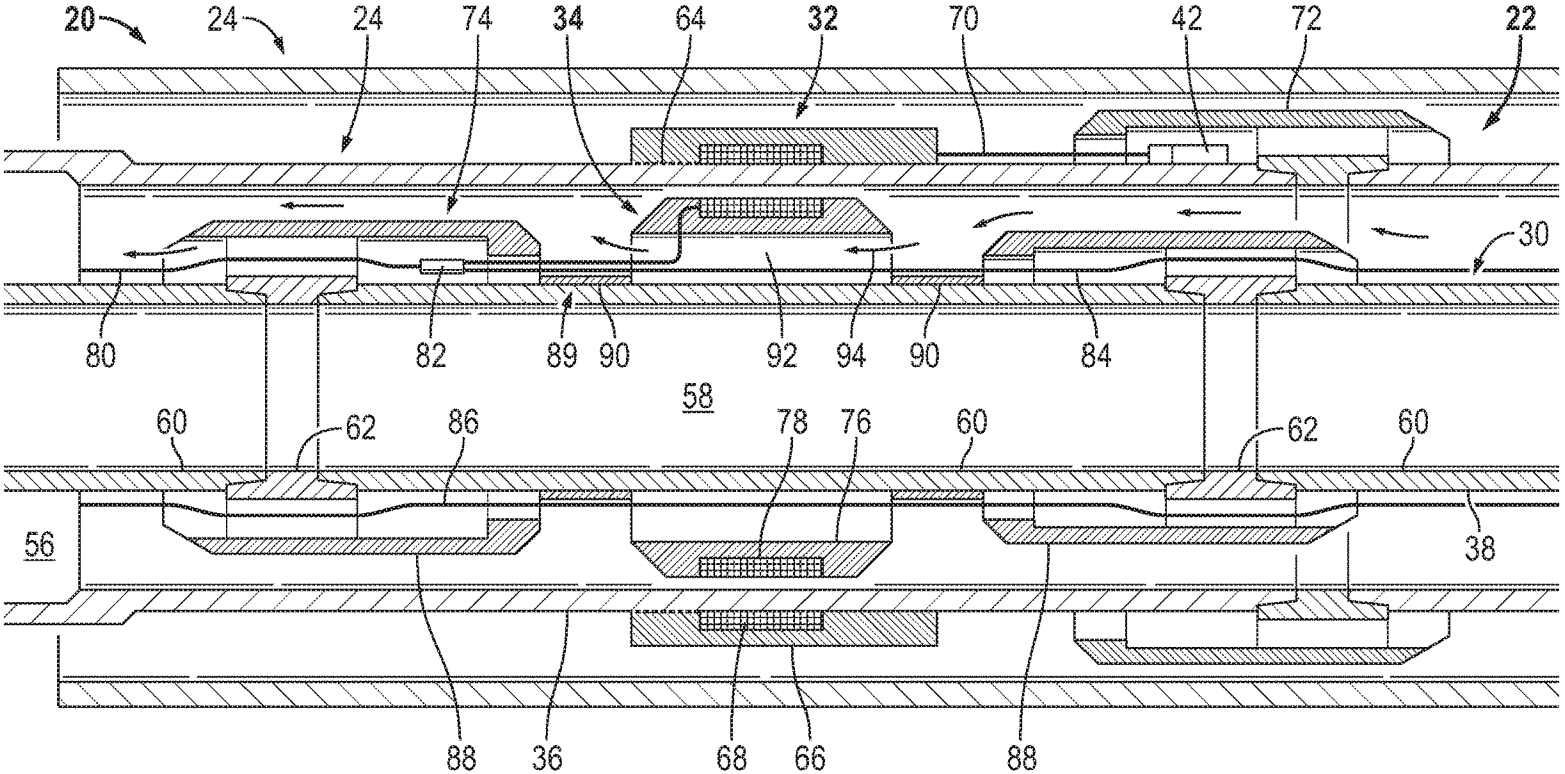
FIG. 2 is a schematic illustration of an inductive coupler system disposed to communicate signals across a casing, according to an embodiment of the disclosure.

Referring generally to FIG. 2, an enlarged example of inductive coupler system 22 is illustrated as deployed along casing 24 and tubing 30. In this example, the casing 24 may be suspended from a tubing hangar 56 and tubing 30 may be in the form of a tubing string having a hollow interior 58 and deployed downhole along the interior of casing 24. In some examples, the tubing 30 may be formed by coupling a plurality of tubing joints 60 together via tubing connectors 62. Sometimes casing joints of casing 24 also may be coupled together by similar connectors 62. However, tubing 30 and casing 24 each may have a variety of configurations and may include several types of tubing string or casing string components.

In the example illustrated, female inductive coupler 32 may be in the form of a slip on coupler which is slid along an exterior of casing 24 and secured at a desired location by a suitable fastener 64, such as a threaded fastener, lock ring, weldment, releasable collar, or other suitable fastener 64. The female inductive coupler 32 may comprise a body 66 and at least one coil 68 mounted within the body 66. The coil is coupled with electrical device/sensor 42 via a communication line 70 for transmitting power and/or data signals to or from the electrical device/sensor 42. In some applications, the electrical device/sensor 42 may be positioned within a housing 72 which may be in the form of a protective clamp or other housing constructed to secure and protect the device/sensor 42 along an exterior of casing 24.

Referring again to the example of FIG. 2, the male inductive coupler 34 may be in the form of a slip on coupler which is slid along exterior 38 of tubing 30 and secured at a desired location by, for example, a suitable clamping mechanism 74. The mail inductive coupler 34 may comprise a body 76 and at least one coil 78 mounted within the body 76. The coil 78 may be coupled with a suitable communication line 40, such as an electrical communication line 80 via, for example, a splice 82. As discussed above, the well system 20 may utilize a variety of communication lines 40 depending on the application. For example, additional electrical and/or optical fiber communication lines 84 may be routed through inductive coupler system 22, e.g. through male inductive coupler 34. Other types of communication lines, such as hydraulic and/or chemical injection lines 86 also may be routed through inductive coupler system 22, e.g. through male inductive coupler 34.

In the example illustrated, the inductive coupler system 22 utilizes clamping mechanism 74 to secure male inductive coupler 34 at the desired location along tubing 30. According to an embodiment, the clamping mechanism of inductive coupler system 22 may comprise clamping mechanism housings 88 positioned on opposite axial sides of male inductive coupler 34. The clamping mechanism housings 88 cooperate with an alignment mechanism 89 in the form of spacers 90 positioned between the clamping mechanism housings 88 and male inductive coupler 34. The spacers 90 may be in the form of spacer tubes and are used to position and lock the male inductive coupler 34 against axial and rotational movement with respect to tubing 30. Additionally, the clamping mechanism housings 88 may serve as protective housings for protecting certain components, such as splice 82 and communication lines 80, 84, 86.

As illustrated, a passage 92 or a plurality of passages 92 may be located through male inductive coupler 34 to serve as bypass channels. The bypass channel or channels 92 are sufficiently sized to accommodate substantial fluid flow, as represented by arrows 94. The bypass channel or channels 92 also provide space and a routing path for routing the desired communication lines, e.g. communication lines 84, 86, through the inductive coupler system 22 by providing a passage through the male inductive coupler 34. The bypass channel(s) 92 thus can be used to facilitate both flow of fluid and routing of communication lines through the inductive coupler system 22. The bypass channels 92 enable substantial fluid flow when, for example, deploying the tubing string 30 downhole or when killing the well. By forming bypass channels 92 of sufficient size, space is provided for many types of communication lines, e.g. electrical lines, fiber-optic lines, hydraulic lines, chemical injection lines, and/or other lines, routed along the tubing 30 and through the inductive coupler system 22.

Figure 3:
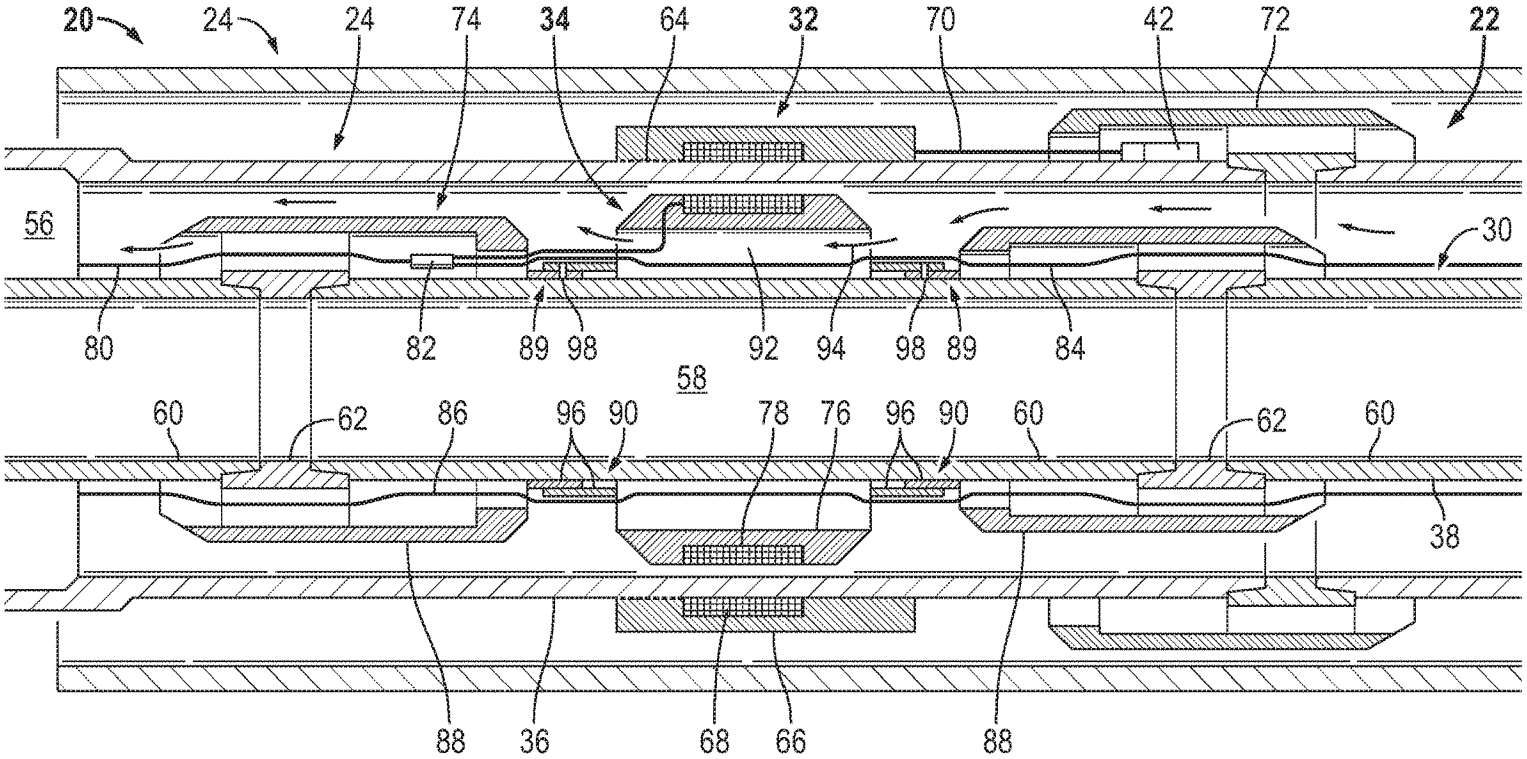
FIG. 3 is a schematic illustration of another example of an inductive coupler system disposed to communicate signals across a casing, according to an embodiment of the disclosure.

Referring generally to FIG. 3, another embodiment of inductive coupler system 22 is illustrated. In this example, the spacers 90 each are constructed with a pair of spacer tubes 96 connected to each other by a member 98, e.g. pin member. For example, the pair of spacer tubes 96 may be in the form of concentric spacer tubes coupled by member 98 in the form of at least one pin. By using pin members 98, the male inductive coupler 34 may be easily spaced out between clamping mechanism housings 88.

Figure 4:
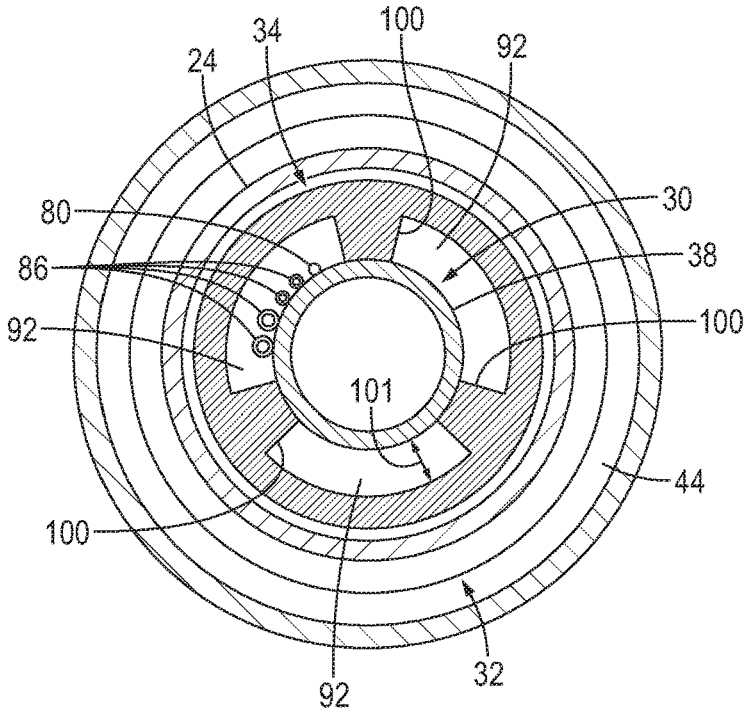
FIG. 4 is a cross-sectional view of an example of an inductive coupler system, according to an embodiment of the disclosure.

In FIG. 4, a cross-sectional view of the inductive coupler system 22 is provided to illustrate an example of an arrangement of bypass channels 92. In this example, tubing 30 comprises production tubing and male inductive coupler 34 is slid onto the production tubing to a desired location and then moved into casing 24 until properly aligned with female inductive coupler 32. The male inductive coupler 34 may be positioned securely along exterior 38 of tubing 30 via radial structures 100 to centralize the male inductive coupler 34 with respect to tubing 30 and to form bypass channels 92 between the radial structures 100. In the specific example illustrated, three bypass channels 92 are located between three radial structures 100. However, the number of bypass channels 92 and radial structures 100 may be adjusted according to the parameters of a given application. As illustrated, the bypass channels 92 provide substantial radial depth 101 and circumferential length between structures 100 to accommodate substantial fluid flow through male inductive coupler 34 and thus through inductive coupler system 22. The communication lines, e.g. communication lines 84, 86, may be routed along one or more of the bypass channels 92.

Figure 5:
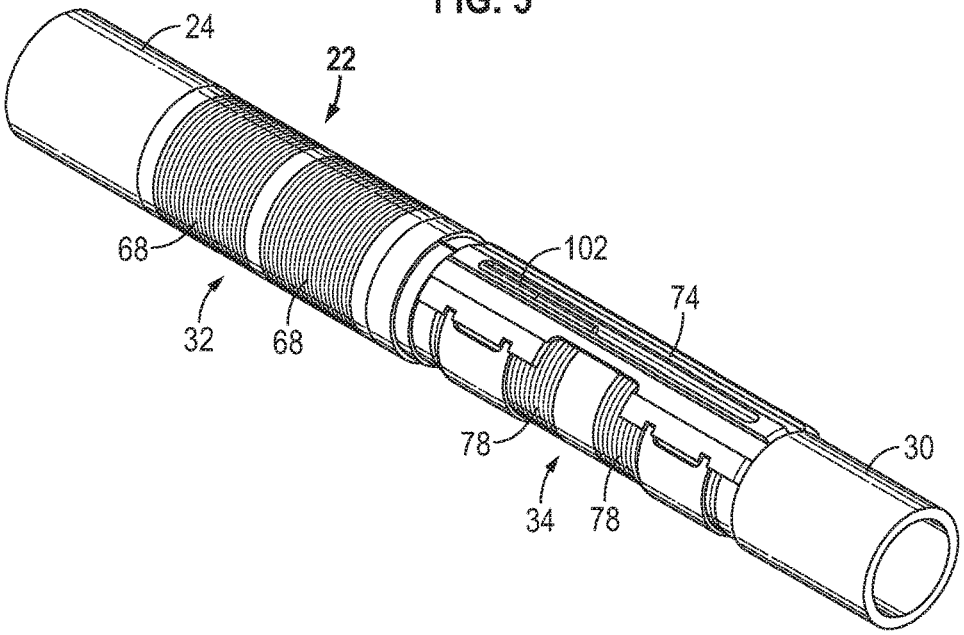
FIG. 5 is an orthogonal view of tubing having a male inductive coupler being moved into casing to align the male inductive coupler with a female inductive coupler mounted along an exterior of the casing, according to an embodiment of the disclosure.

Depending on the application, the female inductive coupler 32, male inductive coupler 34, and corresponding clamping mechanisms, e.g. clamping mechanism 74, may have a variety of configurations. As illustrated by the example in FIG. 5, the male inductive coupler 34 may comprise a plurality of metal straps combined with and held in place via the unitary clamping mechanism 74. The metal straps/unitary clamping mechanism 74 ensure that the coil/coils 78 may be secured along tubing 30 as the tubing 30 is slid into the casing 24 to which the female inductive coupler 32 is mounted (with corresponding coils 68). The clamping mechanism 74 may be constructed to accommodate various bypass channels 92 and other components, such as a sensor 102. The bypass channels 92 may be routed through male inductive coupler 34 in a manner similar to that of the embodiment described above with reference to FIGS. 2-4. However, many other arrangements of clamping mechanisms, sensors, and/or coils may be utilized in a given inductive coupler system 22.

Figure 6:
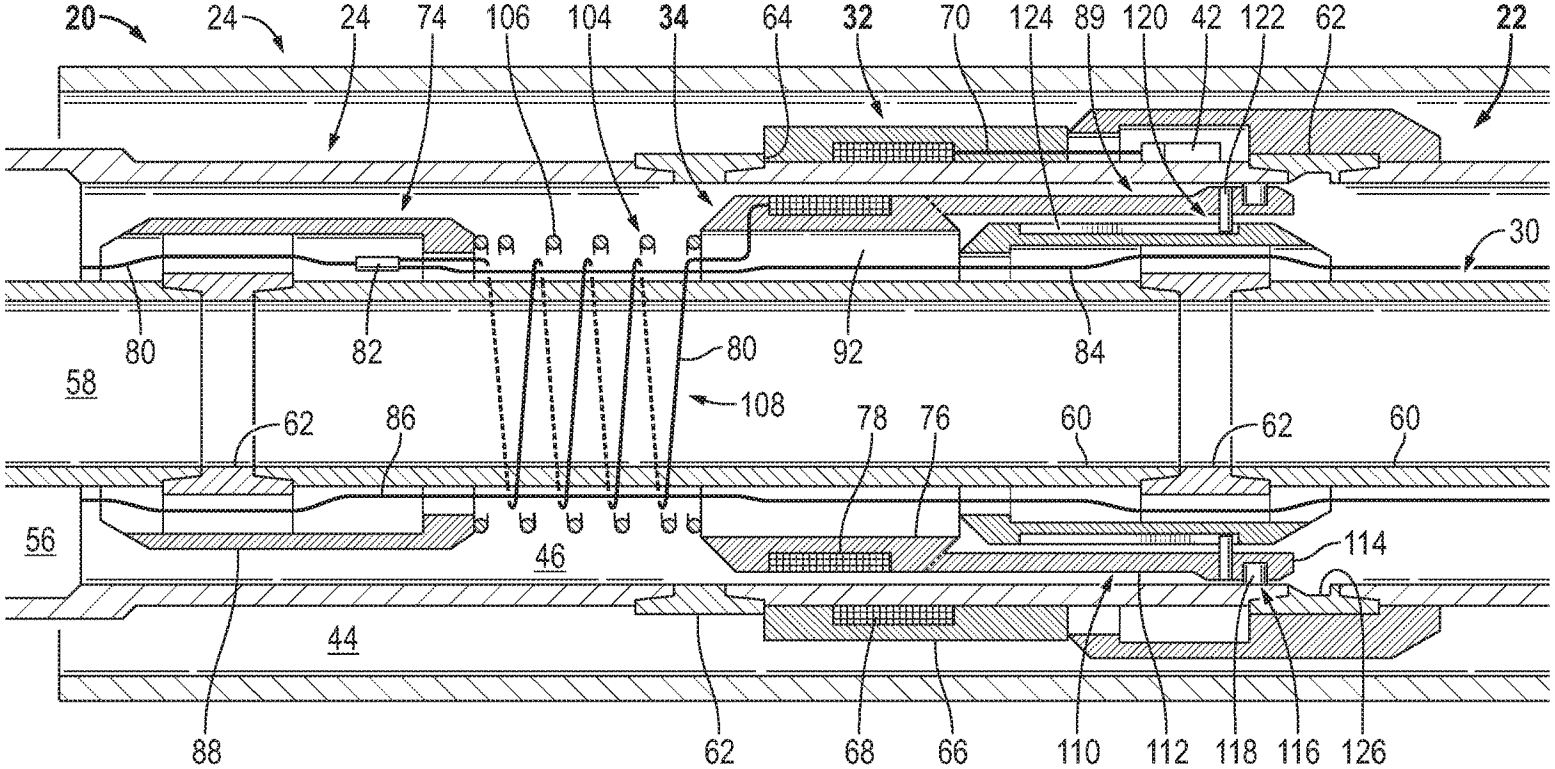
FIG. 6 is a schematic illustration of another embodiment of an inductive coupler system disposed in a well system to communicate signals across a casing, according to an embodiment of the disclosure.
Figure 7:
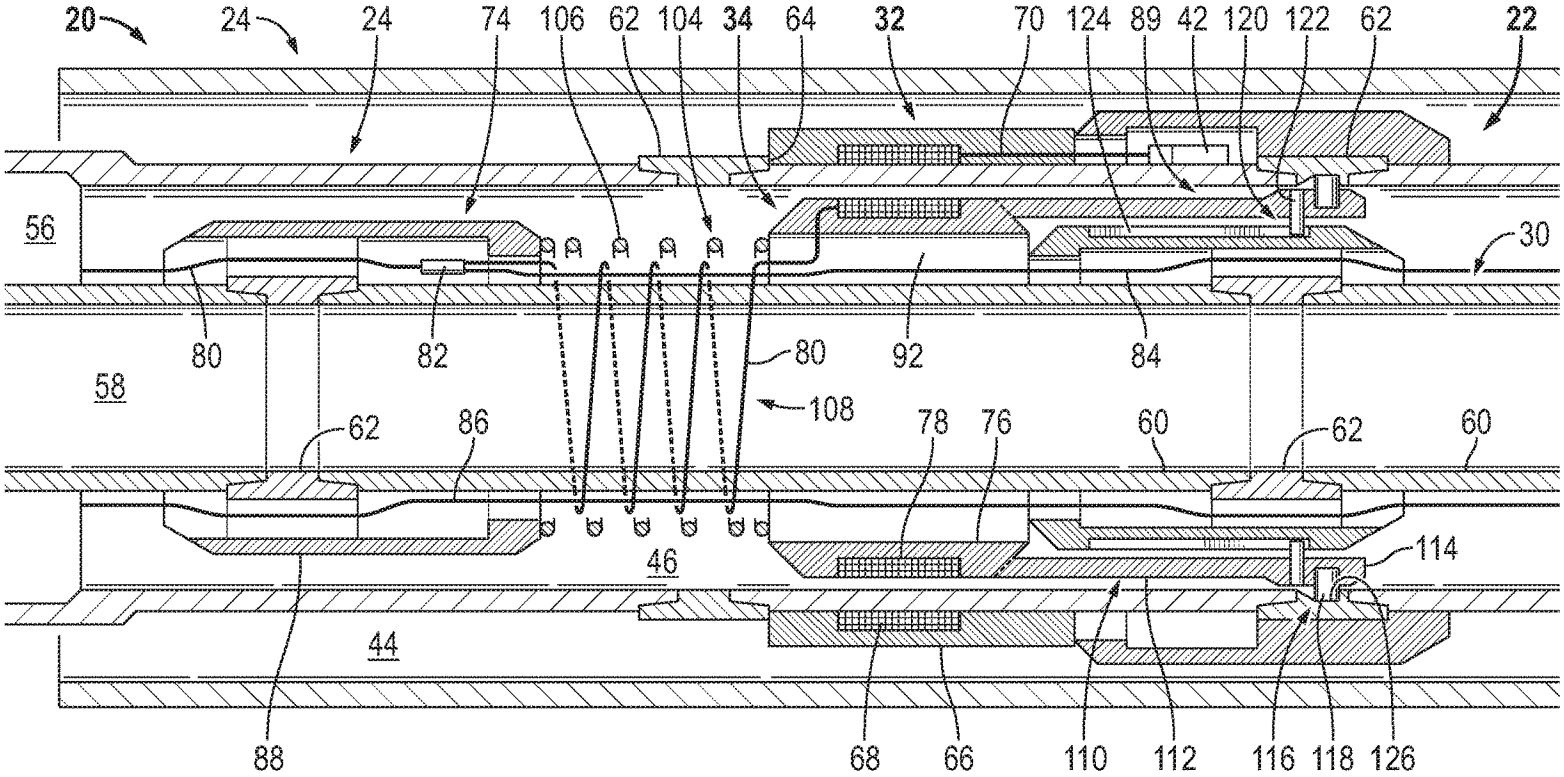
FIG. 7 is a schematic illustration similar to that of FIG. 6 but showing the inductive coupler system and the well system in a different operational position, according to an embodiment of the disclosure.
Figure 8:
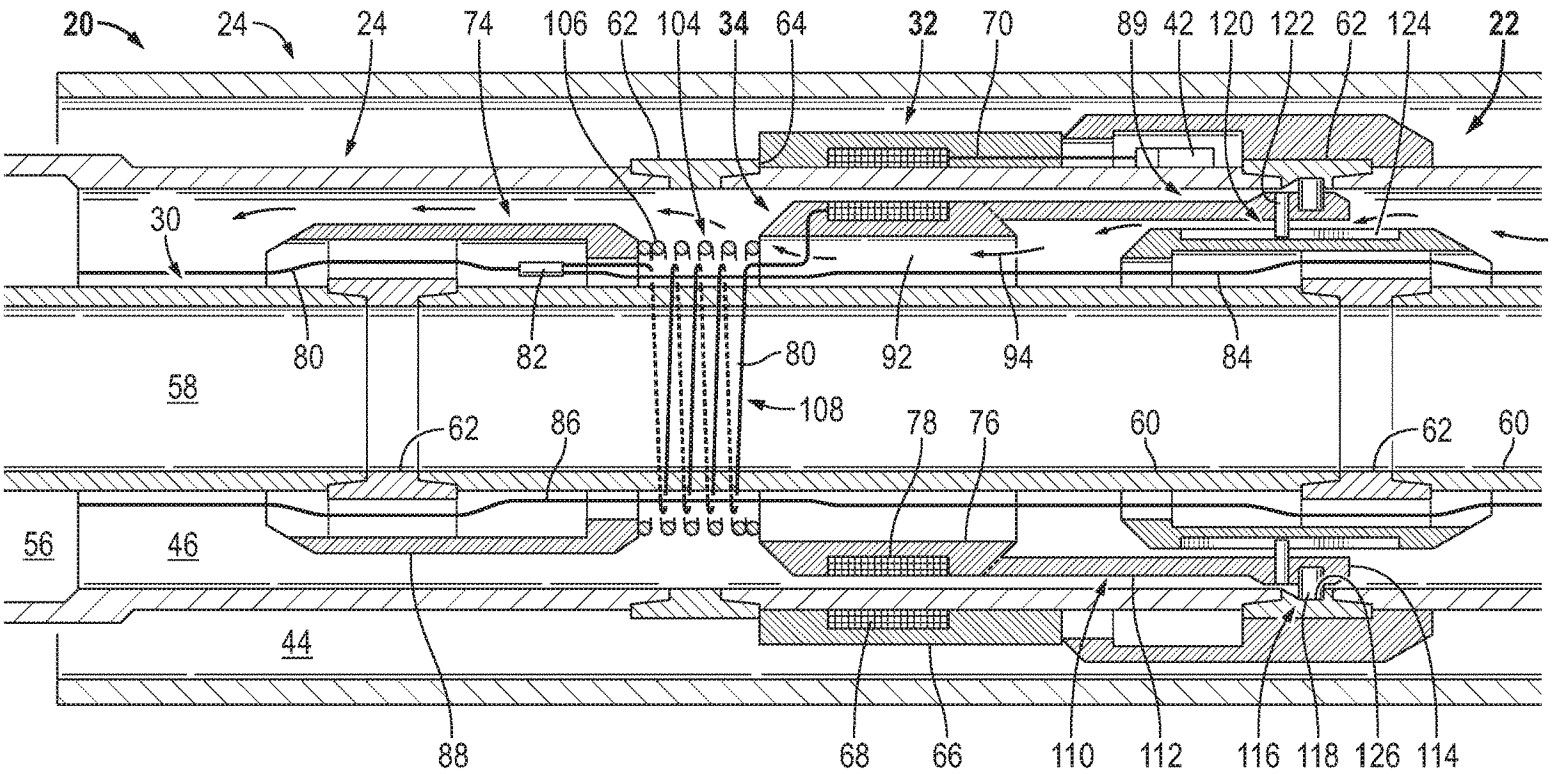
FIG. 8 is a schematic illustration similar to that of FIG. 7 but showing the inductive coupler system and the well system in a different operational position, according to an embodiment of the disclosure.

Referring generally to FIGS. 6-8, another embodiment of inductive coupler system 22 is illustrated. In this embodiment, the male inductive coupler 34 is allowed to float rather than being held by spacers 90. A securing member 104 may be used to hold the male inductive coupler 34 at a desired location along tubing 30 while moving downhole. By way of example, the securing member 104 may comprise a shear member or a spring 106. In the example illustrated, spring 106 is positioned between the body 76 of male inductive coupler 74 and an adjacent cross coupling clamping mechanism housing 88. The communication line 80, e.g. cable, coupled with coil 78 of male inductive coupler 34 may be wrapped around tubing 30 in a coil 108 adjacent spring 106. The coil 108 provides slack in the communication line 80 and thus allows the decoupled male inductive coupler 34 to float between clamping mechanism housings 88.

As illustrated in FIG. 6, the alignment mechanism 89 may be in the form of a positioning member 110 coupled with the body 76 of male inductive coupler 34. By way of example, the positioning member 110 comprises a collet or sleeve 112 having an engagement end 114. In some applications, the engagement end 114 may comprise an engagement feature 116, such as a spring-loaded dog 118 or other suitable engagement feature. In this type of embodiment, rotation of male inductive coupler 34 relative to tubing 30 may be blocked via an anti-rotation mechanism 120. By way of example, the anti-rotation mechanism 120 may comprise a pin 122 extending from sleeve 112 into a slot 124 formed in one of the cross coupling clamping mechanism housings 88. The pin 122 and corresponding slot 124 enable movement of male inductive coupler 34 along tubing 30 in an axial direction while blocking relative rotational movement of coupler 34 with respect to tubing 30.

When tubing 30 is deployed downhole into casing 24, the positioning member 110 moves along the interior of casing 24 until engagement end 114, e.g. spring-loaded dog 118, is received in a corresponding profile 126, e.g. recess, disposed along the interior of casing 24, e.g. within one of the casing connectors 62. As illustrated in FIG. 7, the engagement end 114 engages the corresponding profile 126 and effectively positions the coil 78 of male inductive coupler 34 adjacent the corresponding coil 68 of female inductive coupler 32. This provides a dependable mechanism for properly aligning the male inductive coupler 34 and female inductive coupler 32 both axially and radially to optimize data transmission across casing 24. The floating nature of male inductive coupler 34 along with spring 106 and coil 108 enable movement of tubing 30, as illustrated in FIG. 8, without affecting the proper alignment of male inductive coupler 34 and female inductive coupler 32.

In this latter embodiment, the floating male inductive coupler 34 maintains a similar bypass channel 92 for both fluid flow 94 and routing of communication lines, e.g. communication lines 84, 86. Regardless of the position of male inductive coupler 34 relative to the corresponding clamping mechanism housings 88, fluid is free to flow past the inductive coupler system 22 via bypass channels 92. The coil 108 enables floating of the male inductive coupler 34 without stressing or otherwise affecting the connection between coupler coil 78 and electric communication line 80.

Depending on the parameters of a given application, the structure and components of the wireless coupling system 22, casing 24, devices/sensors 42, 50, 52, and control system to which the devices/sensors are coupled may vary. For example, the wireless coupling system 22 may be an inductive coupling system as described in embodiments above, but the wireless coupling system also may comprise a variety of other wireless coupling systems which utilize the alignment techniques and/or bypass channels described herein. The wireless coupling system 22 may be constructed to facilitate alignment of various types of wireless couplers 32, 34. Additionally, casing 24 may be constructed in a variety of sizes and configurations along the wellbore 25 for cooperation with many types of well completions and other downhole equipment. In some applications, the casing may comprise a non-well related casing. Similarly, the devices/sensors 42, 50, 52 may comprise many types of sensors, e.g. pressure sensors, temperature sensors, resistivity sensors, flow sensors, and/or other sensors deployed to monitor well related parameters external to the casing or both external and internal to the casing. The control system to which the devices/sensors are coupled also may comprise various types of power supplies and/or processing systems for processing data transmitted uphole with the aid of inductive coupler system 22.

The inductive coupler system 22 also may comprise many configurations of female inductive couplers and male inductive couplers. In some applications, each of the female and male inductive couplers comprises a single coil. However, other applications may utilize two or more coils in each of the female and male inductive couplers. Various materials, e.g. various metals, also may be used to form the components of inductive coupler system 22. Similarly, the number of turns of each coil and the electromagnetic circuitry associated with those coils may vary according to the configuration of the inductive coupler system and the environment in which the system is operated. Various mechanism configurations also may be used to ensure the inductive couplers are moved into close proximity with each other during alignment. In some applications, the inductive couplers are slid onto the tubing or casing, but other applications may utilize integrated couplers. For example, the female inductive coupler 32 may be part of an assembly and corresponding sections of the casing may be made up to the assembly.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well casing deployed in a wellbore;

a tubing disposed in the well casing; and a wireless coupler system providing wireless transmission of signals across the well casing, the wireless coupler system comprising:

a female coupler positioned along the well casing; and a male coupler positioned at a desired location along the tubing, the male coupler comprising an alignment mechanism for aligning the male coupler with the female coupler, the wireless coupler system further comprising a body having a fluid bypass channel, the alignment mechanism having a positioning member which is spring-loaded to engage a corresponding profile associated with the well casing when the male coupler is aligned with the female coupler, the tubing being allowed to move linearly within the male coupler after the positioning member engages the corresponding profile.

2. The system as recited in claim 1, wherein the male coupler is decoupled from the tubing via sliding of the male coupler over the tubing.

3. The system as recited in claim 1, wherein the male coupler and the female coupler cooperate to transmit at least one of data signals and power signals across the well casing.

4. The system as recited in claim 1, wherein the male coupler comprises a male inductive coupler and the female coupler comprises a female inductive coupler generally in close proximity with each other.

5. The system as recited in claim 1, wherein the body is part of the male coupler and comprises a plurality of fluid bypass channels.

6. The system as recited in claim 5, wherein a communication line is routed through at least one of the fluid bypass channels.

7. The system as recited in claim 1 wherein the alignment mechanism comprises a plurality of spacers.

8. The system as recited in claim 1, wherein the male coupler is decoupled from the tubing, the positioning member having an engagement end configured for receipt in the corresponding profile.

9. The system as recited in claim 8, wherein the engagement end comprises a spring-loaded dog received in the corresponding profile.

10. The system as recited in claim 8, wherein a communication line is coupled with the male coupler and includes a coil to accommodate floating movement of the male coupler.

11. A method of inductively transferring signals in a well environment, comprising:

locating a male inductive coupler along a tubing;

moving a female inductive coupler to a desired position along an exterior of a well casing;

operatively coupling a sensor to the female inductive coupler;

deploying the tubing into the well casing to locate the male inductive coupler at a desired position within the female inductive coupler;

providing a bypass channel through the male inductive coupler to enable fluid flow through the male inductive coupler as the tubing is deployed into the well casing;

setting a position of the male inductive coupler relative to the female inductive coupler; and after setting the position, allowing the tubing to move within the male inductive coupler.

12. The method as recited in claim 11, further comprising locating the sensor externally of the well casing.

13. The method as recited in claim 12, wherein locating the sensor comprises locating a pressure sensor, and wherein the method further comprises using the pressure sensor to monitor well integrity.

14. The method as recited in claim 12, further comprising communicating electrical signals across the well casing between the female inductive coupler and the male inductive coupler.

15. The method as recited in claim 11, further comprising routing at least one communication line through the bypass channel.

16. The method as recited in claim 11, further comprising enabling floating of the male inductive coupler between housings mounted along the tubing.

17. The method as recited in claim 16, further comprising positioning the male inductive coupler at an optimal position with respect to the female inductive coupler via a positioning member having an engagement end captured by a corresponding profile.

18. A system, comprising:

a male inductive coupler located along an exterior of a tubing, the male inductive coupler being positioned internally of the female inductive coupler to enable transmission of signals across the well casing, the male inductive coupler comprising a fluid bypass channel therethrough; and a clamping mechanism to secure the male inductive coupler at a desired position along the tubing, the clamping mechanism having a plurality of clamping mechanism housings which cooperate with an alignment mechanism having spacer tubes connected by a member in a manner which sets desired spacing between the plurality of clamping mechanism housings and the male inductive coupler.

19. The system as recited in claim 18, further comprising a sensor mounted externally of the casing and connected with the female inductive coupler.

20. The system as recited in claim 18, wherein the fluid bypass channel comprises a plurality of fluid bypass channels; and wherein the system further comprises at least one communication line routed through at least one bypass channel of the plurality of bypass channels.

* * * * *